US008916799B2

(12) United States Patent
Martinez et al.

(10) Patent No.: US 8,916,799 B2
(45) Date of Patent: Dec. 23, 2014

(54) FLAT ELECTRIC HEATER ELEMENT, IN PARTICULAR FOR GLASS PANES OF A MOTOR VEHICLE

(75) Inventors: Jose A. Martinez, Franklin Park, IL (US); Erik Arnold, Gorxheimertal (DE)

(73) Assignee: Illinois Tool Works Inc., Glenview, IL (US)

( * ) Notice: Subject to any disclaimer, the term of this patent is extended or adjusted under 35 U.S.C. 154(b) by 1268 days.

(21) Appl. No.: 12/519,375

(22) PCT Filed: Aug. 31, 2007

(86) PCT No.: PCT/EP2007/059085

§ 371 (c)(1),
(2), (4) Date: Jun. 16, 2009

(87) PCT Pub. No.: WO2008/074521

PCT Pub. Date: Jun. 26, 2008

(65) Prior Publication Data

US 2010/0032421 A1 Feb. 11, 2010

Related U.S. Application Data

(60) Provisional application No. 60/876,179, filed on Dec. 20, 2006.

(51) Int. Cl.
*H05B 3/84* (2006.01)

(52) U.S. Cl.
CPC ..... *H05B 3/84* (2013.01); *H05B 2203/002* (2013.01); *H05B 2203/017* (2013.01)
USPC ..... 219/203; 219/520

(58) Field of Classification Search
USPC ..... 219/219, 203, 505, 522, 541, 543, 553; 52/171.2; 428/156, 426, 432, 435; 204/192.1
See application file for complete search history.

(56) References Cited

U.S. PATENT DOCUMENTS

| | | | | |
|---|---|---|---|---|
| 3,221,145 | A * | 11/1965 | Hager, Jr. | 219/549 |
| 3,878,362 | A * | 4/1975 | Stinger | 219/528 |
| 4,399,347 | A * | 8/1983 | Schmitt | 219/203 |
| 4,952,783 | A * | 8/1990 | Aufderheide et al. | 219/528 |
| 6,084,217 | A * | 7/2000 | Bulgajewski | 219/505 |
| 6,559,419 | B1 * | 5/2003 | Sol et al. | 219/203 |
| 7,053,344 | B1 * | 5/2006 | Surjan et al. | 219/549 |
| 7,301,125 | B2 * | 11/2007 | Davis | 219/201 |
| 2002/0015824 | A1 | 2/2002 | Kawamoto et al. | |

(Continued)

FOREIGN PATENT DOCUMENTS

| | | | |
|---|---|---|---|
| DE | 102004050158 | B3 | 4/2006 |
| EP | 1168888 | A2 | 1/2002 |

(Continued)

OTHER PUBLICATIONS

ISR for PCT/EP2007/059085 dated Nov. 9, 2007.

*Primary Examiner* — Thien S Tran
(74) *Attorney, Agent, or Firm* — Lowe Hauptman & Ham LLP

(57) ABSTRACT

Flat electric heater element having a self-adhesive surface for the purpose of adhesive-bonding to a glass pane of a motor vehicle, and having a passage opening to allow the passage of signals from/to a signaling device which is installed in the motor vehicle.

19 Claims, 4 Drawing Sheets

(56) References Cited

U.S. PATENT DOCUMENTS

| | | | | |
|---|---|---|---|---|
| 2003/0102296 | A1* | 6/2003 | Nelson et al. | 219/217 |
| 2004/0065651 | A1 | 4/2004 | Voeltzel | |
| 2004/0100131 | A1* | 5/2004 | Howick et al. | 297/180.12 |
| 2004/0200821 | A1 | 10/2004 | Voeltzel | |
| 2005/0089691 | A1* | 4/2005 | Noguchi et al. | 428/426 |
| 2006/0011597 | A1* | 1/2006 | Dyrdek | 219/203 |
| 2009/0044464 | A1 | 2/2009 | Schmidt et al. | |

FOREIGN PATENT DOCUMENTS

| | | | |
|---|---|---|---|
| EP | 1466877 | A1 | 10/2004 |
| EP | 1672960 | A1 | 6/2006 |
| GB | 2381179 | A | 4/2003 |
| WO | 03015473 | A2 | 2/2003 |

* cited by examiner

FLAT ELECTRIC HEATER ELEMENT, IN PARTICULAR FOR GLASS PANES OF A MOTOR VEHICLE

RELATED APPLICATIONS

The present application is based on International Application Number PCT/EP2007/059085 filed Aug. 31, 2007, and claims priority from U.S. Application No. 60/876,179 filed Dec. 20, 2006, the disclosures of which are hereby incorporated by reference herein in their entirety.

BACKGROUND

The present invention relates to a flat electric heater element, in particular for heating a small region of a glass pane of a motor vehicle.

EP 1 281 574 B1 discloses a flat electric heater element for heating a mirror of a motor vehicle. Two current conductor layers and one electrical resistance layer are formed on a carrier film as the heater element. The resistance layer extends between the two current conductor layers and is in electric contact with both of them. The flat heater element has an unobstructed, light-diffusing area for the light of a signal indicator. The electrical resistance layer is composed of a material with a positive temperature coefficient (PTC). The electrical resistance of the said material is temperature-dependent. It increases as the temperature rises and decreases as the temperature falls.

The object of the invention is to provide a way of reducing the risk of signal transmission defects, which can be caused by snow, ice or condensation water, for electrical signaling devices, which communicate with external devices, in motor vehicles, even when only a small amount of installation space is available in the motor vehicle.

SUMMARY

The invention particularly relates to the use of such a flat heater element for heating regions of glass panes of a motor vehicle.

The invention also relates to a motor vehicle which is provided with at least one such flat electric heater element.

BRIEF DESCRIPTION OF THE DRAWINGS

The invention will be described below with reference to the drawings using preferred embodiments as examples. In the said drawings.

DETAILED DESCRIPTION

Figure 1:
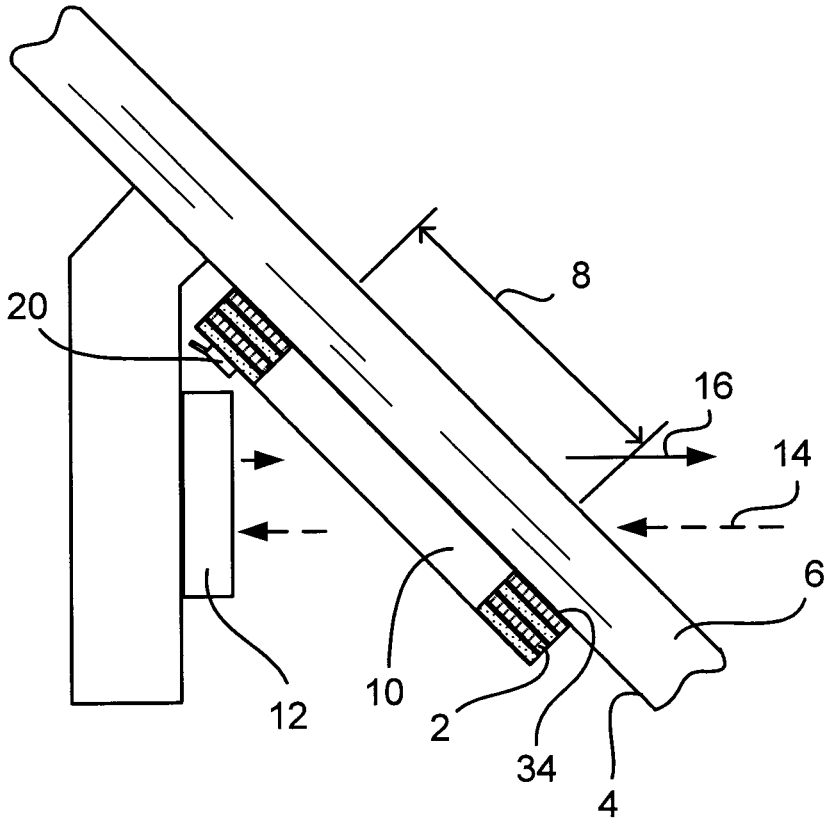
FIG. 1 shows a cross section through a glass pane of a motor vehicle, which glass pane may be a front windscreen or a rear windscreen of a passenger compartment of a vehicle, in combination with a flat electric heater element according to the invention which is adhesively bonded on the inner face of the glass pane, and in combination with a schematically illustrated signaling device, FIG. 2 schematically shows a broken-away cross section through the flat heater element according to the invention.

FIG. 1 schematically shows a cross section through a flat electric heater element 2 according to the invention, which flat electric heater element is adhesively bonded to the inner face 4 of a glass pane 6 of a motor vehicle in order to heat a small region 8 of the glass pane, which region is opposite a passage opening 10 in the flat heater element and a signaling device 12 which is arranged in the motor vehicle (not illustrated). As a result, the signaling device 12 can receive signals 14 or transmit signals 16 through the passage opening 10 and the heated region 8 of the glass pane depending on whether the signaling device is a receiver, a transmitter or a transceiver. The flat heater element 2 is flexible.

The glass pane 6 is preferably a windscreen or a rear windscreen of the passenger compartment of a motor vehicle. However, the glass pane 4 may also be a side pane of a passenger compartment or a glass pane which is arranged outside the passenger compartment, for example in the engine compartment or beneath the rear boot space, in order to protect a signaling device 12, which is likewise arranged there, against dirt and water.

Heat which is generated by the flat heater element 2 in the region 8 of the glass pane prevents or clears condensation water and also melts and therefore likewise clears ice and snow. This ensures that the signals 14 and/or 16 can penetrate the region 8 of the glass pane without obstruction.

The sensor device 12 may take different forms, for example a device for generating a warning signal when the motor vehicle falls below a predetermined distance from the edge of the road (lane departure warning); a distance sensor in the form of a parking aid when parking the motor vehicle; a distance sensor for generating a warning signal and/or a vehicle deceleration signal in order to prevent an accident when the motor vehicle comes too close to an obstacle, for example a motor vehicle travelling in front or a stationary motor vehicle, at the normal driving speed; a camera or a film camera; a sensor for receiving signals relating to road-use charges (toll charges); a transmitter, for example for transmitting signals to receivers which register road charges for the motor vehicle; a transmitter for transmitting information signals to other motor vehicles; a transceiver which can perform both transmission and reception operations for the said or other purposes.

The received signals 14 and/or the transmitted signals 16 may be electromagnetic waves, radar signals or sonar signals, depending on the purpose of the signaling device 12.

The drawings show the flat electric heater element 2 with a greatly enlarged thickness for the purpose of illustrating the various details. In reality, the flat heater element 2 may be less than 1 mm thick, for example 0.3 mm. Only electric connection elements 18 and 20, if present, have a slightly greater thickness.

A preferred embodiment of a flat electric heater element 2 according to the invention is illustrated in FIGS. 1 to 4. The said flat electric heater element is a flexible body. It contains a carrier film 22 which is composed of opaque or preferably transparent plastic and extends around the passage opening 10; two current conductor layers 24 and 26 which are arranged on a first face 28 (front face) of the carrier film 22 and extend at a lateral distance from one another; an electrical resistance layer 30 as a heat conductor which generates heat, which electrical resistance layer is arranged on the same first film face 28 of the film and extends between the two current conductor layers 24 and 26 and is also in electric contact with the two current conductor layers 24 and 26, with the result that electric current can flow through the resistance layer 30 between the current conductor layers 24 and 26, substantially transverse to the latter. All of the layers 24, 26, 30 or individual layers 24, 26, 30 may be composed of transparent material. The electrical resistance layer 30 is preferably composed of a material which has a positive temperature coefficient (PTC), with the result that its electrical resistance value automatically increases as the temperature rises and decreases as the temperature falls. The two current conductor layers 24 and 26 preferably lie in the same layer plane.

The flat heater element 2 is in the form of a frame around the passage opening 10. The carrier film 22, the two current conductor layers 24 and 26 and the electrical resistance layer 30 extend around the passage opening 10 in the manner of a frame.

An adhesive layer 32, whose surface 34 which faces away from the carrier film 22 is self-adhesive for the purpose of adhesive-bonding to the glass pane 6, extends over the current conductor layers 24 and 26 and the electrical resistance layer 30.

As long as the flat heater element 2 is not adhesively bonded to the glass pane 6, the self-adhesive surface 34 is covered by a protective pull-off layer 36, for example made of paper or a plastic film.

Figure 3:
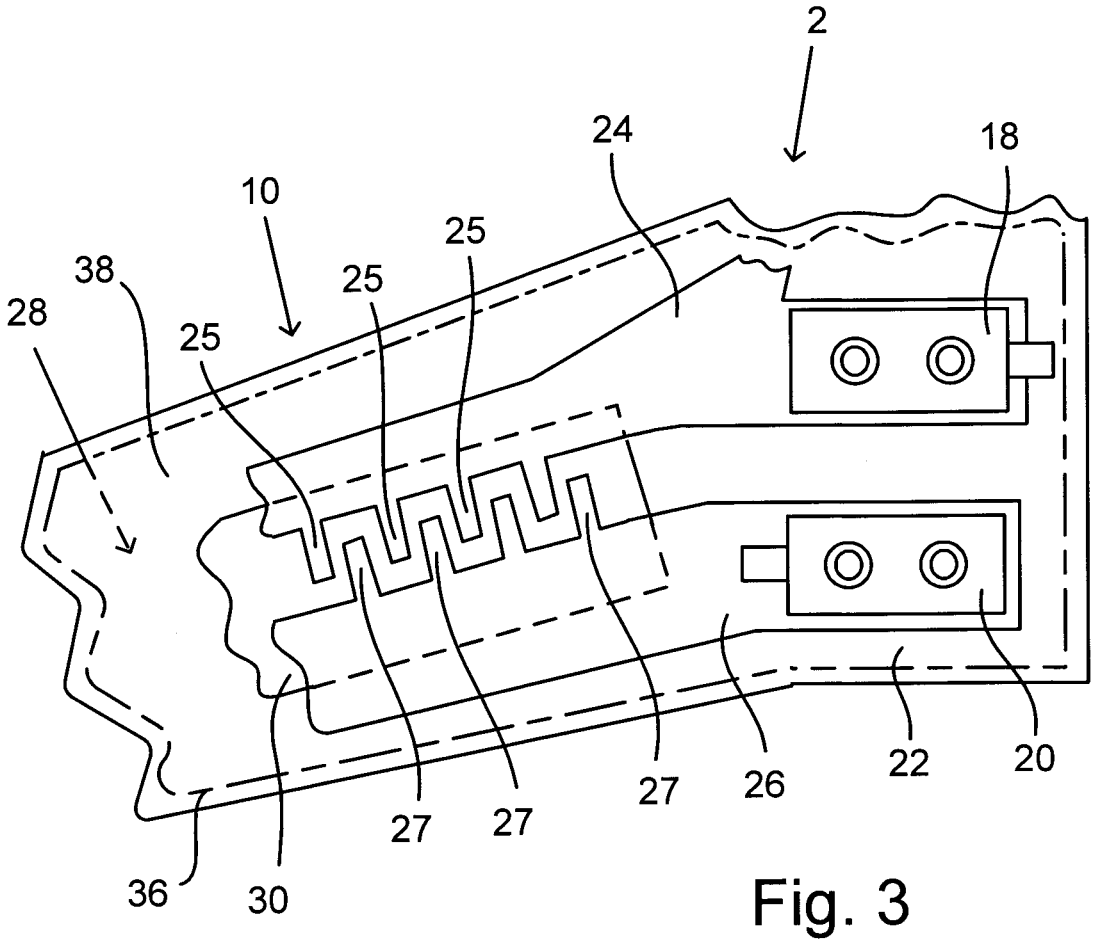
FIG. 3 shows a detail of the rear view (view from underneath FIG. 2) of the flat heater element according to the invention.
Figure 4:
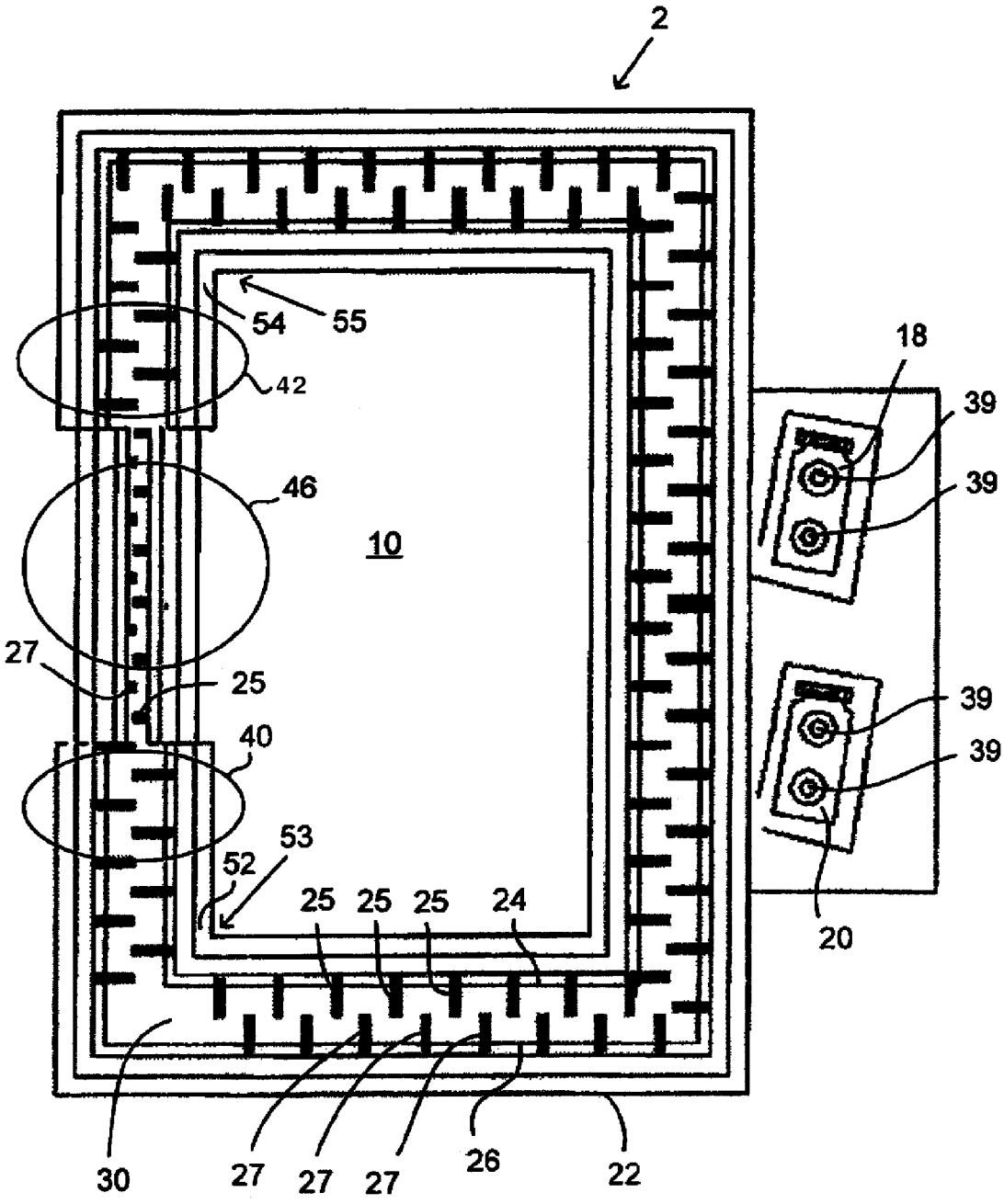
FIG. 4 shows a rear view of a preferred first embodiment of the flat heater element according to the invention.

FIGS. 3 and 4 are "perspective" illustrations of the flat heater element 2 as seen from its rear face, that is to say as if all of the layers are composed of transparent material. FIGS. 3 and 4 show the rear face, which is the second film face 38 of the flat heater element 2. In FIGS. 3 and 4, the carrier film 22 is the topmost layer, and the protective layer 36 is the lowermost layer.

Figure 2:
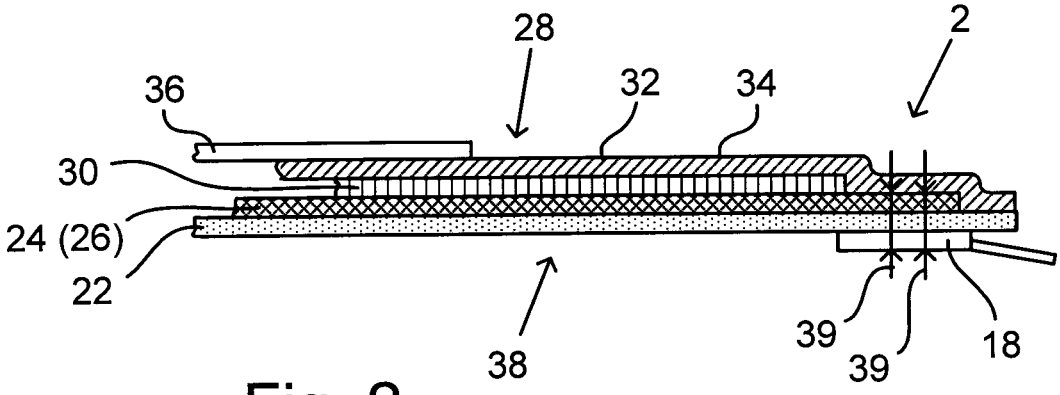

According to FIG. 2 and FIG. 3, the two connection elements 18 and 20 are arranged on the second face 38 (rear face), which faces away from the first face 28 (front face), of the carrier film 22. The said connection elements are each electrically conductively connected to one of the two current conductor layers 24, 26 by electric conductors, preferably rivets 39, through the carrier film 22. The electric connection elements 18 and 20 are preferably in the form of plugging elements onto which mating plugging elements of electric conductors from a power source can be plugged.

Embodiments of the flat electric heater element 2 which do not have any connection elements 18 and 20, but in which end portions of the electric current conductor layers 24 and 26 are provided, onto which end portions power supply lines can be plugged or soldered, are also possible.

A further layer (not shown) which is composed of electrically insulating material may be located between the adhesive layer 32 on the one hand and the electrical resistance layer 30 and the current conductor layers 24 and 26 on the other hand.

The two current conductor layers 24 and 26 and the electrical resistance layer 30 are produced using a thin-film process or a thick-film process. A preferred process is the screen printing process. Furthermore, it is also possible to use photoelectric and chemical processes and also etching processes.

As shown in FIG. 4 in particular, at least one current conductor layer 24, for example the current conductor layer 24 which is radially on the inside in relation to the passage opening 10, is preferably a layer which extends continuously around the entire passage opening 10, and thus is an electric ring line. The other, radially outer current conductor layer 26 may also be in the form of a continuous ring line which extends around the entire passage opening 10. According to other embodiments (not shown) of the invention, one and/or the other of the two current conductor layers 24, 26 may have a finite length with two ends.

The current conductor layers 24 and 26 may have projections 25 and, respectively, 27 which in each case protrude away in the direction of the other current conductor in question in the form of a comb and are likewise in contact with the electrical resistance layer 30. Distribution of the heating power can be influenced by the size and positioning of these projections 25 and 27.

In this way and/or on account of different widths of the heater element 2 and the resistance layer 30, it is possible to distribute the heating power around the passage opening 10 in a predetermined manner in such a way that a homogeneous distribution of heat is produced very rapidly in the region 8 of the glass pane.

Furthermore, corner regions 52, 54 of the heater element 2 can be designed for a lower heating power than in adjacent regions of the flat heater element 2 as a result of such measures, in order to thus prevent more heat being generated in the glass pane 6 in the corners 53, 55 of the passage opening 10 than in the regions remote from the corners 53, 55.

As shown as an example in FIG. 4, the carrier film 22 of the flat heater element 2 has at least one or more regions 40, 42 with more electrical resistance material 30 for generating more heating heat (more heating energy) and, in each case adjacent to the said regions, at least one or more relatively narrower regions 46 with less resistance material 30 for generating less heating heat (less heating energy), in such a way that thermal compensation in the sense of a more homogeneous distribution of heat is produced in the region 8 of the glass pane which is to be heated. It is therefore possible to adapt the flat heater element 2 to the space conditions in the motor vehicle and thus to also advantageously use it when there is not enough space at certain points in the motor vehicle to design the flat heater element 2 to be of equal width throughout.

The terms "wider" and "narrower" relate to regions which are adjacent to one another, of which one region is relatively wide and the other region is narrower in relation to it.

Figure 5:
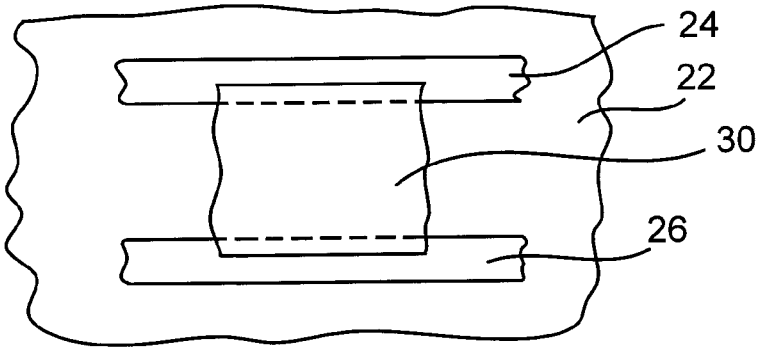
FIG. 5 shows a broken-away, enlarged front view of a detail of the flat heater element according to the invention.
Figure 6:
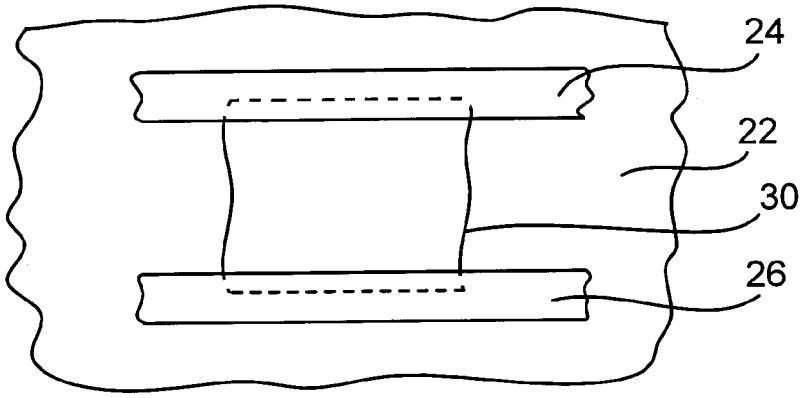
FIG. 6 shows a broken-away, enlarged front view of a first variant according to the invention of the detail from FIG. 5.
Figure 7:
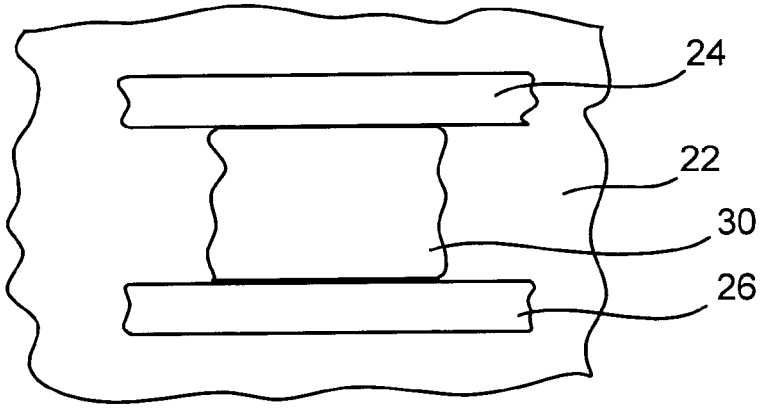
FIG. 7 shows a broken-away, enlarged front view of a second variant according to the invention of the detail from FIG. 5.

FIGS. 5, 6 and 7 are front views of the flat heater element 2 as seen on the first film face 28. They show different variants of the flat heater element 2.

According to the variant of FIG. 5, first the two current conductor layers 24 and 26 and then the electrical resistance layer 30 (heat conductor) are applied to the carrier film 22, with the electrical resistance layer 30 at least partially overlapping the two current conductor layers 24 and 26 and thus being in good electrical contact with them.

According to the variant of FIG. 6, first the electrical resistance layer 30 has been applied to the carrier film 22 and then the two current conductor layers 24 and 26 have been applied to the carrier film 22. In this embodiment too, the current conductor layers 24 and 26 each at least partially overlap the resistance layer 30, with the result that they are in good electrical contact with it.

FIG. 7 shows a variant in which the two current conductor layers 24 and 26 are applied to the carrier film 22 in such a way that they do not overlap the electrical resistance layer 30 which is likewise applied to the carrier film 22, but only touch the edge of the said electrical resistance layer. The variants according to FIGS. 5 and 6 are more functionally reliable than the variant according to FIG. 7.

In place of a single passage opening 10, a flat electric heater element according to the invention may also have two or more passage openings 10 around which the flat heater element 2 and its current conductor layers 24 and 26 and the electrical resistance layer 30 extend.

The invention claimed is:

1. A flat electric heater element, comprising:

a carrier film;

two current conductor layers arranged on a first face of the carrier film at a distance from each other;

an electrical resistance layer arranged on the first face, extending between the two current conductor layers and being in electrically conductive contact with the two current conductor layers, wherein an electric current is flowable through the electrical resistance layer between the current conductor layers;

an adhesive layer including electrically insulating material and disposed over the electrical resistance layer and the current conductor layers, wherein the adhesive layer has a self-adhesive surface for adhesively bonding the flat electric heater element to an element to be heated, and the element to be heated includes thermally conductive material; and at least one passage opening, the carrier film, the current conductor layers and the electrical resistance layer extending around the passage opening, wherein the carrier film has at least one relatively wide region and at least one relatively narrow region adjacent to the at least one relatively wide region along an edge of the passage opening, the at least one relatively wide region of the carrier film carries more electrical resistance material of the electrical resistance layer than the at least one relatively narrow region for generating more heating energy than the at least one relatively wide region, and the carrier film, the two current conductor layers, and the electrical resistance layer are all present in the at least one relatively wide region and in the at least relatively narrow region along the edge of the passage opening.

2. The flat electric heater element according to claim 1, wherein the electrical resistance layer includes a material having a positive temperature coefficient, and a resistance of the material is configured to increase as a temperature rises and decrease as the temperature falls.

3. The flat electric heater element according to claim 1, wherein at least one of the two current conductor layers, the adhesive layer, and the electrical resistance layer is screen printed.

4. The flat electric heater element according to claim 1, wherein at least one of the two current conductor layers is a continuous ring line extending around an entirety of the at least one passage opening.

5. The flat electric heater element according to claim 1, further comprising electric connection elements on a second face of the carrier film facing away from the first face, wherein the connection elements are electrically conductively connected to the current conductor layers.

6. The flat electric heater element according to claim 1, further comprising a protective pull-off layer on the self-adhesive surface of the adhesive layer.

7. A motor vehicle, comprising:

a flat electric heater element;

a glass pane; and a signaling device, wherein the flat heater element is adhesively bonded to inside of the glass pane for heating a region of the glass pane, the flat heater element includes:

a carrier film;

two current conductor layers arranged on a first face of the carrier film at a distance from each other;

an electrical resistance layer arranged on the first face, extending between the two current conductor layers and being in electrically conductive contact with the two current conductor layers, wherein an electric current is flowable through the electrical resistance layer between the current conductor layers;

an adhesive layer including electrically insulating material and disposed over the electrical resistance layer and the current conductor layers, wherein the adhesive layer has a self-adhesive surface for adhesively bonding the flat heater element to the glass pane; and at least one passage opening, the carrier film, the two current conductor layers and the electrical resistance layer extending around the passage opening, wherein the carrier film has at least one relatively wide region and at least one relatively narrow region adjacent to the at least one relatively wide region along an edge of the passage opening, the at least one relatively wide region of the carrier film carries more electrical resistance material of the electrical resistance layer than the at least one relatively narrow region for generating more heating energy than the at least one relatively wide region, the carrier film, the two current conductor layers, and the electrical resistance layer are all present in the at least one relatively wide region and the at least relatively narrow region along the edge of the passage opening, said region of the glass pane is opposite the passage opening of the flat heater element, the signaling device is configured to receive or transmit signals through the passage opening and the region of the glass pane, and the signaling device is at least one of a receiver, a transmitter or a transceiver.

8. The flat electric heater element according to claim 1, wherein the carrier film, the two current conductor layers, the adhesive layer, and the electrical resistance layer define a closed loop surrounding the passage opening.

9. The flat electric heater element according to claim 8, wherein each of the current conductor layers comprises projections alternatingly arranged along the closed loop.

10. The flat electric heater element according to claim 9, wherein each of the projections protrudes from one of the current conductor layers toward the other current conduct layer and is in contact with the electrical resistance layer.

11. The flat electric heater element according to claim 1, wherein the electrical resistance layer at least partially overlaps the two current conductor layers, and the two current conductor layers are positioned between the carrier film and the electrical resistance layer.

12. The flat electric heater element according to claim 1, wherein the electrical resistance layer at least partially overlaps the two current conductor layers, and the electrical resistance layer is positioned between the carrier film and the two current conductor layers.

13. The flat electric heater element according to claim 1, wherein the electrical resistance layer is between the two current conductor layers without overlapping the two current conductor layers.

14. The flat electric heater element according to claim 1, wherein a distance between opposite side edges of the at least one relatively wide region is larger than a distance between opposite side edges of the at least one relatively narrow region, and a distance between the two current conductor layers in the at least one relatively wide region is larger than that in the at least one relatively narrow region.

15. The flat electric heater element according to claim 14, wherein the carrier film, the electrical resistance layer and the two current conductor layers have elongated shape, and each of the carrier film, the electrical resistance layer and the two current conductor layers continuously extends around the at least one passage opening to define a closed loop.

16. The motor vehicle according to claim 7, wherein a distance between opposite side edges of the at least one relatively wide region is larger than a distance between opposite side edges of the at least one relatively narrow region, and a distance between the two current conductor layers in the at least one relatively wide region is larger than that in the at least one relatively narrow region.

17. The motor vehicle according to claim 16, wherein the carrier film, the electrical resistance layer and the two current conductor layers have elongated shape, and each of the carrier film, the electrical resistance layer and the two current conductor layers continuously extends around the at least one passage opening to define a closed loop.

18. The flat electric heater element according to claim 14, wherein a distance between opposite side edges of the electrical resistance layer in the at least one relatively wide region is larger than in the at least one relatively narrow region.

19. The motor vehicle according to claim 16, wherein a distance between opposite side edges of the electrical resistance layer in the at least one relatively wide region is larger than in the at least one relatively narrow region.

* * * * *